United States Patent [19]

Castle

[11] Patent Number: 4,506,477

[45] **Date of Patent: * Mar. 26, 1985**

[54] CURTAIN ROD FOR SLIDING GLASS DOOR

[76] Inventor: Ross M. Castle, 100 Castle Dr., Florissant, Mo. 63034

[ * ] Notice: The portion of the term of this patent subsequent to Jul. 14, 1998 has been disclaimed.

[21] Appl. No.: 283,234

[22] Filed: Jul. 14, 1981

Related U.S. Application Data

[63] Continuation-in-part of Ser. No. 77,004, Sep. 19, 1979, Pat. No. 4,277,913.

[51] Int. Cl.[3] ..... E06B 7/00

[52] U.S. Cl. ..... 49/70; 49/54; 49/65; 160/90

[58] Field of Search ..... 49/70, 50, 54, 65; 160/89-92, 225, 402, 345, 330; 211/105.3, 105.5, 105.6; 411/516, 517, 352, 351; 292/262, 259 R, 338, 339, 175; 403/108, 326, 378, 379, DIG. 6

[56] References Cited

U.S. PATENT DOCUMENTS

| | | | |
|---|---|---|---|
| 386,423 | 7/1888 | Cornell | 292/259 |
| 1,062,478 | 5/1913 | Kroder | 211/105.3 |
| 1,128,420 | 2/1915 | Decker | 292/175 |
| 1,405,416 | 2/1922 | Howell et al. | 160/92 |
| 1,509,098 | 9/1924 | Callender | 160/92 |
| 1,581,185 | 4/1926 | Ellis | 292/262 |
| 1,785,838 | 12/1930 | McClure | 49/70 X |
| 2,138,843 | 12/1938 | Dupuis | 403/378 X |
| 2,568,827 | 9/1951 | Schallock | 403/108 X |
| 2,865,662 | 12/1958 | Nurmse | 403/378 X |
| 2,974,805 | 3/1961 | Brosseau | 211/105.5 |
| 3,117,689 | 1/1964 | Dedic, Sr. | 292/262 X |
| 3,342,273 | 9/1967 | Crane | 403/379 X |
| 4,277,913 | 7/1981 | Castle | 49/70 |

*Primary Examiner*—Philip C. Kannan

*Attorney, Agent, or Firm*—Senniger, Powers, Leavitt and Roedel

[57] ABSTRACT

A curtain rod for a sliding glass door in a wall comprising a first rod section, a pair of brackets mounting the first rod section on the door in position extending generally horizontally across a face of the door, a second rod section, and a bracket mounting the second rod section independently of the door in axial alignment with the first rod section. The first and second rod sections have a sliding fit with respect to each other and constitute an extensible rod assembly, the rod assembly being extended as the door is closed and contracted as the door is opened. The rod assembly is adapted to support a curtain extending across the face of the door in both closed and open positions of the door. The curtain rod further comprises a lock for preventing contraction of the assembly and thus the opening of the door. The lock comprises at least one hole in one of the rod sections and a locking ring adapted to be applied thereto for providing a fixed external shoulder on the rod section engageable with a stop member alongside the rod section. The locking ring comprises a first elongate portion having a generally closed shape and spaced-apart ends, the ring being adapted to be carried on the rod section in a position in which the first portion of the ring substantially surrounds the rod, and a second elongate portion extending from one end of the first portion inwardly with respect to the closed shape into the hole in the rod section when the ring is in its stated position.

8 Claims, 4 Drawing Figures

CURTAIN ROD FOR SLIDING GLASS DOOR

CROSS REFERENCE TO RELATED APPLICATION

This application is a continuation-in-part of my U.S. patent application Ser. No. 77,004, filed Sept. 19, 1979, now U.S. Pat. No. 4,277,913, issued July 14, 1981.

BACKGROUND OF THE INVENTION

This invention relates to curtain rods, and more particularly to a curtain rod for a sliding glass door in a wall.

Although curtain rods for swinging doors have long been available, such rods are not practical for use on sliding glass doors because of interference with the operation of the door assembly. Thus, either the curtain rod or a portion thereof secured to a movable door panel would abut against a fixed door panel or wall, or vice versa, thereby blocking the movement of the movable door panel to its fully opened position.

Because of the impracticality of hanging curtains thereon, the use of sliding doors has involved an esthetic penalty. Independent of esthetics, the use of sliding glass doors has presented a safety hazard, with numerous injuries incurred by children and adults who run, fall, or thrust a limb through a glass panel of such a door.

SUMMARY OF THE INVENTION

Among the several objects of this invention may be noted the provision of a curtain rod adapted to support a curtain extending across the entire face of a sliding glass door assembly without interfering with the operation of the door assembly; the provision of such a curtain rod which acts as a safety barrier for reducing the likelihood of people colliding with the door assembly and breaking the glass door panels; the provision of such a curtain rod which may be locked so as to prevent the unintended opening of the door assembly; and the provision of such a curtain rod which may be selectively locked in different positions so as to allow the movable door to be moved to partially opened positions, while preventing movement of the door to a fully opened position.

Briefly, the curtain rod of this invention is for use on a sliding glass door in a wall. It comprises a first rod section and first means for mounting the first rod section on the door in position extending generally horizontally across a face of the door, the first rod section being spaced laterally from said face for supporting a plurality of hooks or the like adapted to support a curtain. It further comprises a second rod section and second means for mounting the second rod section independently of the door in axial alignment with the first rod section. The rod sections have a sliding fit with respect to each other and constitute an extensible rod assembly, the rod assembly being extended as the door is closed and contracted as the door is opened and being adapted to support a curtain extending across the face of the door in both closed and open positions of the door. Locking means associated with the extensible rod assembly selectively prevents its contraction and thus the opening of the door. The locking means comprises at least one hole in one of the rod sections and a locking ring adapted to be applied to said one rod section for providing a fixed external shoulder thereon engageable with a stop member alongside said one rod section. The locking ring comprises first and second elongate portions. The first ring portion has a generally closed shape and spaced-apart ends, the ring being adapted to be carried on said one rod section in a position in which said first portion of the ring substantially surrounds said one rod section. The second ring portion extends from one end of the first portion inwardly with respect to said closed shape to form a prong receivable in the hole in said one rod section when the ring is in said position surrounding the rod section, thereby to releasably secure the ring on said one rod section in fixed axial position with respect thereto.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
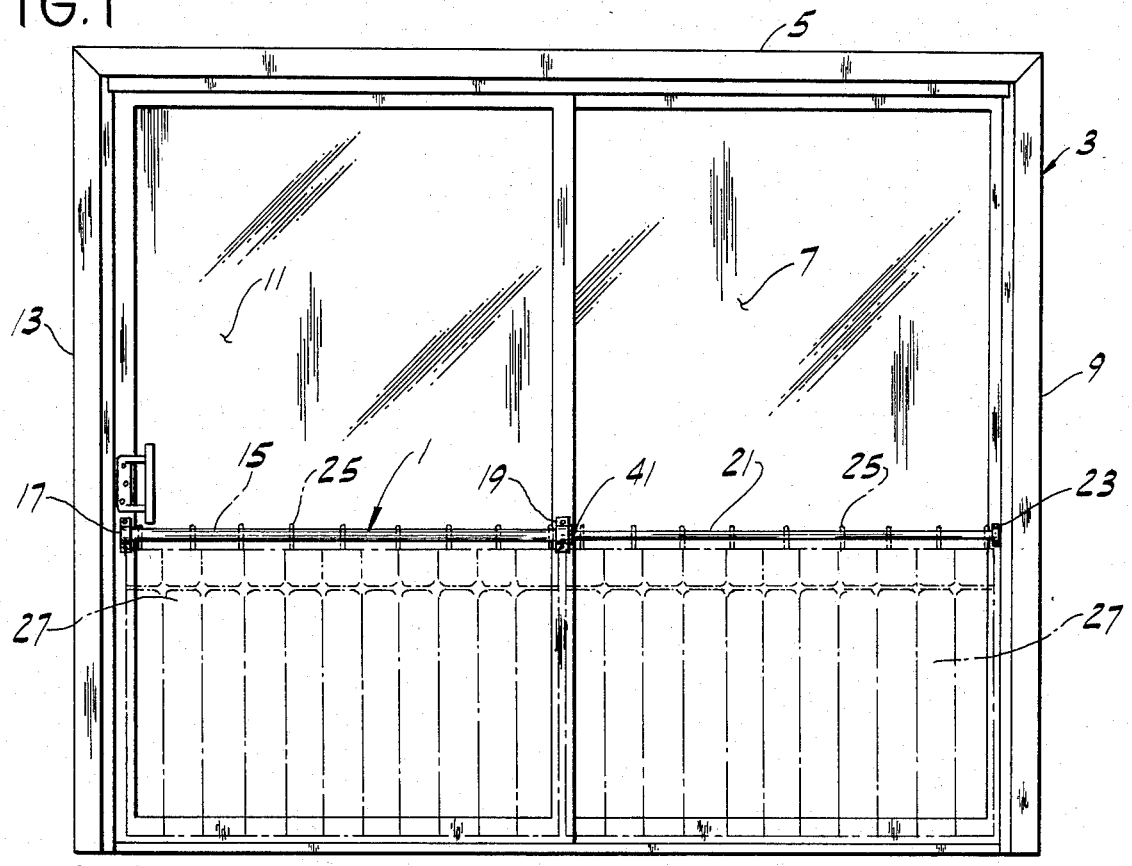
FIG. 1 is an elevation of a curtain rod of this invention attached to a glass door in a wall showing the door in its closed position.

Referring to the drawings, there is generally indicated at 1 a curtain rod of this invention for a glass door assembly 3 in a wall comprising a frame 5 for securement to the wall, a first or fixed glass door panel 7 secured to the frame at a first end 9 of the frame and a second or movable glass door panel 11 slideable in the frame toward and away from a closed position at a second end 13 of the frame.

The curtain rod comprises a first rod section 15 and means such as first and second brackets 17 and 19, respectively, for mounting the first rod section on the movable door panel in position extending generally horizontally across a face of the movable door panel. The curtain rod further comprises a second rod section 21 and means such as third bracket 23 for securing the second rod section to the frame in axial alignment with the first member. The first rod section 15 is spaced laterally from the face of the movable door panel 11 and the second rod secton 21 is spaced laterally from a face of the fixed door panel 7 for supporting a plurality of hooks or the like 25 adapted to support a curtain generally indicated at 27. The rod sections have a sliding fit with respect to each other and constitute an extensible rod assembly, the rod assembly extending as the movable door panel is moved toward its closed position shown in FIG. 1 and retracting as the movable door panel is moved away from its closed position to an open position shown in FIG. 2. The assembly of the first and second rod sections is adapted to support a curtain extending across the faces of the first and second door panels in both closed and open positions of the movable door panel.

In particular, the first rod section 15 comprises a length of circular cross section tube approximately as long as the movable door panel is wide. It is releasably secured at one end thereof in a circular recess in the bracket 17 by conventional fastening means such as a setscrew 18 threaded in a hole in the first bracket, and is received at its other end in a circular opening in the second bracket 19. The brackets are secured to opposite ends of the movable door panel by conventional fastening means such as screws 29. A resilient stop such as a cylinder of rubber 31 or a compression spring (not shown) may be disposed within the first rod section, this stop is engageable at one end thereof with the first bracket and at its other end with the second rod section for limiting the travel of the second rod section relative to the first rod section upon moving the movable door panel to a fully opened position as more fully described hereinafter. A bushing 33 of a material having a low coefficient of friction is releasably secured within the first rod section at its other end for guiding the second rod section and spacing the exterior surface thereof from the interior surface of the first rod section to reduce the friction on the rod sections upon closing the movable door section.

The second rod section 21 is a length of circular cross section tubing having an outside diameter less than the inside diameter of the bushing 33 so that it may be received within the first rod section through the bushing in sliding engagement. One end of the second rod is closed by a plug 35 engageable with the stop 31 and the other end is releasably secured in a circular recess in the third bracket 23 by conventional fastening means such as a setscrew 36 threaded in a hole in the third bracket 23. The third bracket is mounted on the frame by conventional means such as screws 29. The second rod section is slightly longer than the fixed door panel is wide so that it will extend within the first rod section with the movable door panel in closed position.

As described above, the first and second rod sections constitute an extensible rod assembly, the rod assembly extending as the movable door panel is moved toward its closed position and retracting as the movable door panel is moved away from its closed position. An important feature of this invention is the provision of lock means 37 for selectively securing the rod assembly in an extended position to prevent the unintended movement of the movable door member to its fully open position. The lock means comprises a series of holes 39 at spaced intervals along the second rod section 21, and a locking ring 41 adapted to be selectively secutred in fixed axial position on the second rod section at any one of the holes for presenting an external shoulder on the second rod section engageable with the outer end of the bushing 33, the bushing thus functioning as a stop member for the second rod section.

Figure 3:
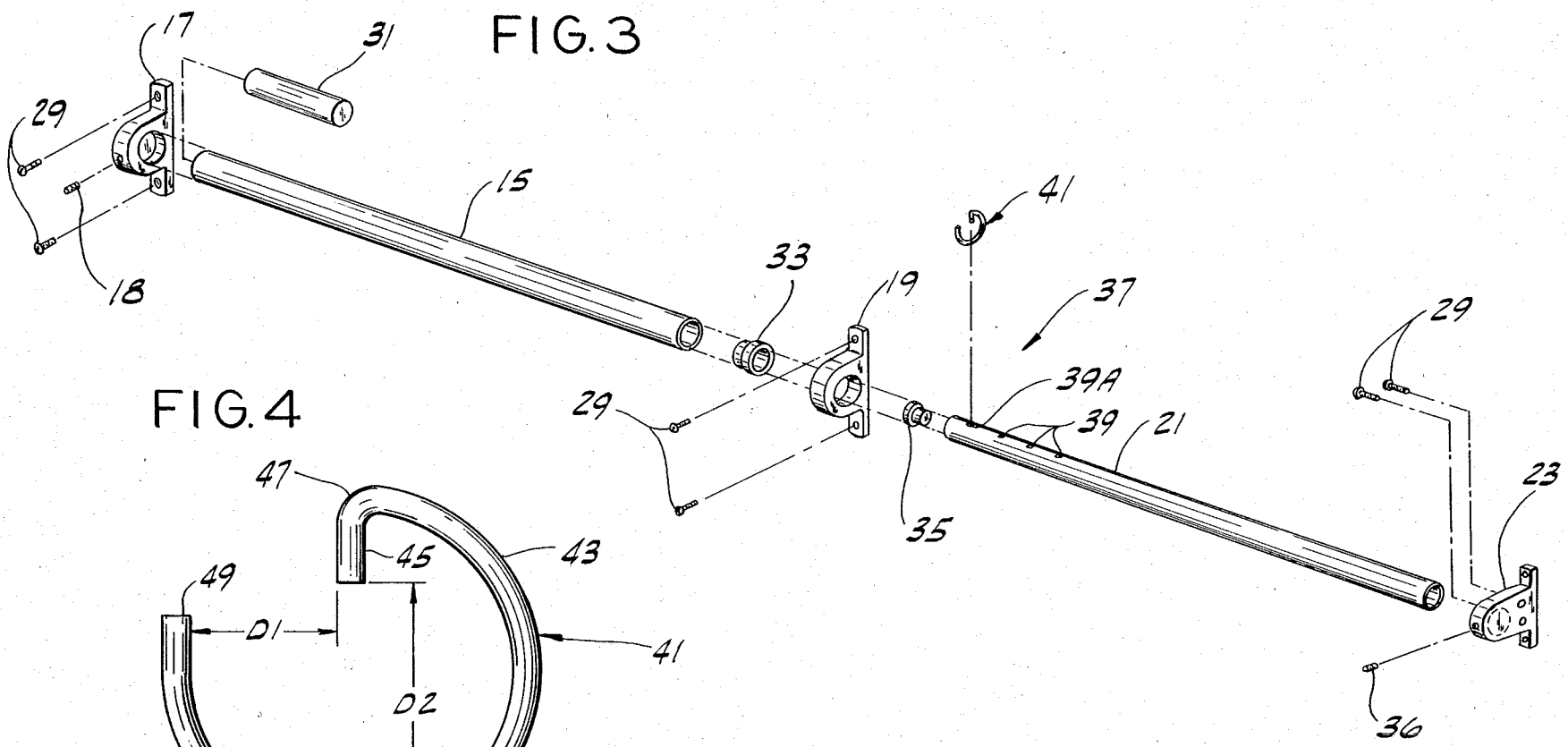
FIG. 3 is an enlarged, exploded view of the curtain rod.
Figure 4:
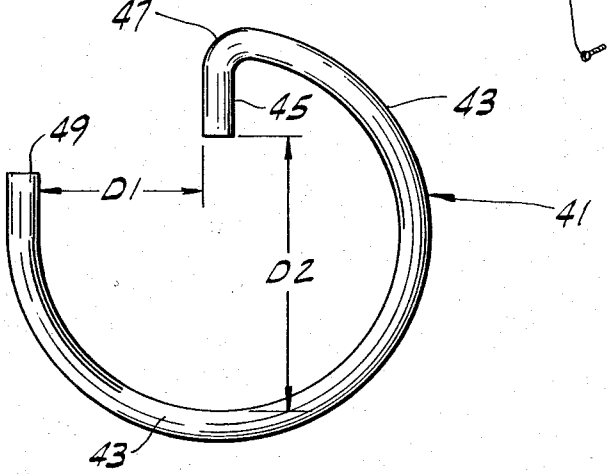
FIG. 4 is an enlarged elevation of a locking ring of the curtain rod.

The locking ring 41 comprises a single elongate member of a suitable material, such as hard drawn spring steel wire, having a uniform circular section throughout its length. The wire is formed by conventional metal working processes into a configuration, such as shown in FIGS. 3 and 4, in which the longitudinal axis of the wire extends in a single plane, and in which the ring is provided with first and second integral portions (43, 45, respectively). The first ring portion 43 is generally in the shape of an arc of a circle and has spaced-apart ends 47, 49, the ring being carried on the rod in a position in which the first ring portion substantially surrounds the rod section. The second ring portion 45 extends from the end 47 of the first ring portion radially inwardly relative to the circular shape defined by the latter to form a prong receivable in any one of the holes 39 for holding the ring in fixed axial position on the rod section, when the first ring portion is in its surrounding position.

The distance, designated D1 in FIG. 4, between the inner end of the prong and the end 49 of the first ring portion is less than the diameter of the second rod section 21 for holding the ring captive on the second rod section 21. The distance, designated D2 in FIG. 4, between the inner end of the prong and the diametrically opposed segment of the first ring portion is greater than the diameter of the second rod section, so that the ring may be lifted relative to second rod section to a position in which the prong is above the second rod section, and thus is free to be moved axially therealong. In addition, the ring, when not used for locking, may be rotated to an inverted position (not shown) in which the prong is below the second rod section and the ring is free to slide thereon upon opening and closing of the doors assembly. The end margin of the first ring portion at its end 49 is bent outwardly so as to extend along a line tangent to the circle defined by the first ring portion and parallel to the axis of the second ring portion to prevent marring of the curtain rod as it slides therealong.

In the use of the lock means 37, the locking ring 41 may be moved to an axial position on the second rod section 21 in which the prong of the ring is received in a hole, indicated at 39A, disposed closely adjacent the end of the bushing 33 (when the extensible rod assembly is fully extended) for preventing the opening of the movable door panel 11 from its fully closed position. In this mode, the lock means functions as an auxiliary lock for supplementing the conventional lock (not shown) of the door assembly. With the locking ring moved to an axial position along the second rod section in which its prong is received in one of the holes 39 disposed to the right of hole 39A, the locking ring enables the movable door panel to be moved toward a partially opened position, thus enabling ventilation yet blocking unintended entry through the door assembly. Lifting of the locking ring from its locking position by someone at the outside of the door assembly 1 is not possible in that any attempt to reach the locking ring through the partially opened door assembly would result in the bushing 33 being moved into pressurized engagement against the ring thereby holding it affixedly secured in the hole 39.

Figure 2:
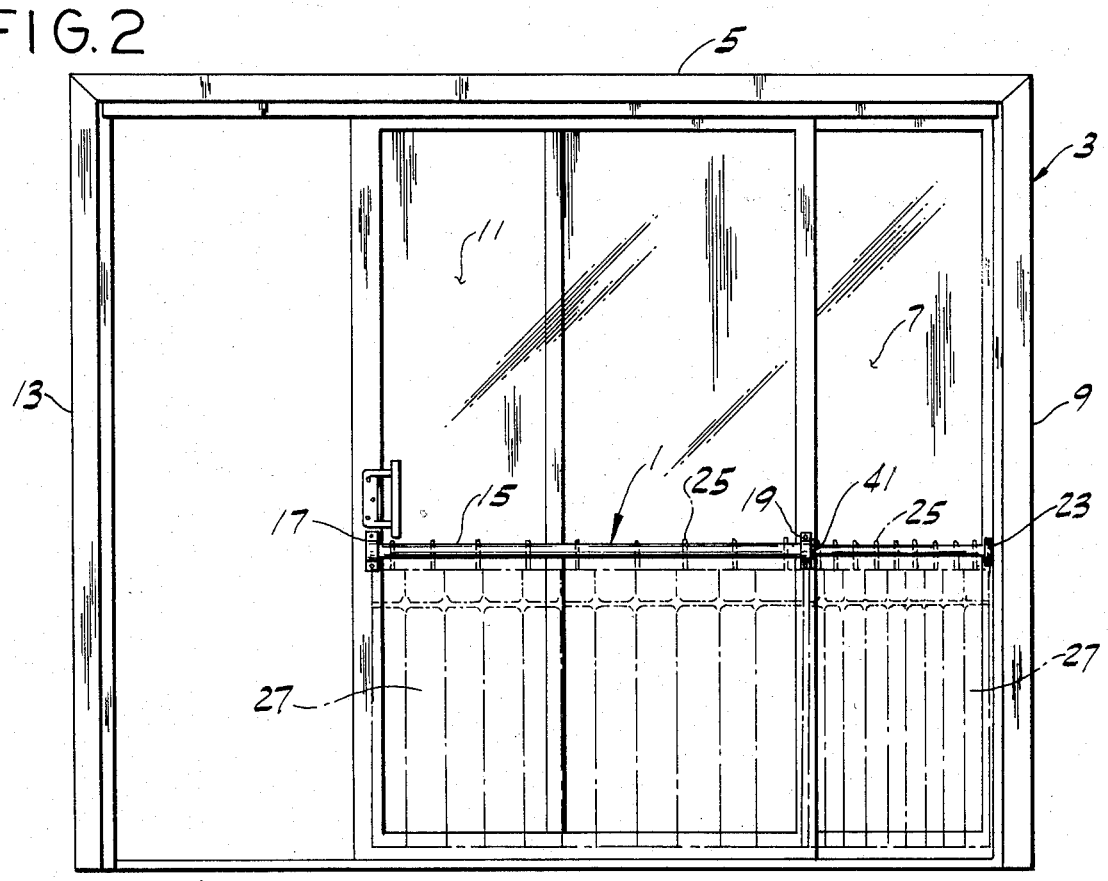
FIG. 2 is a view similar to FIG. 1 but showing the door in open position.

As shown in FIG. 2, with the movable door panel in its closed position the curtain rod 1 of this invention supports the hooks 25 at spaced intervals therealong and supports the curtain 27 across the faces of both the movable and fixed door panels. The height of the curtain may be adjusted by varying the mounting location of the brackets 17, 19 and 23 on the door panels and frame. The curtain may thus cover all or just portions of the faces of the door panels to give the desired decorative effect and degree of privacy. The curtain rod, when extended and with its locking means in its locking mode, prevents entry through the door from the face or side of the door assembly opposite that upon which the curtain rod is mounted. In addition, the curtain rod, whether the rod assembly is extended or contracted, acts as a safety barrier to reduce the likelihood of people colliding with and breaking the glass door panels of the door assembly.

As the movable door panel 11 is moved to open position, the rod assembly contracts with the second rod section sliding under the hooks 25 supported thereon, and the portion of the curtain 27 extending across the face of the fixed door panel 7 gathers together in a rucked condition. The movable door panel 11 may be opened by moving the door panel away from the end 13 of the frame 5 until the door panel reaches its fully opened position at which point the second rod section 21 is in engagement with the resilient stop 31.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A curtain rod for a sliding glass door in a wall, said curtain rod comprising:

a first rod section;

first means for mounting the first rod section on the door in position extending generally horizontally across a face of the door, said rod section being spaced laterally from said face for supporting a plurality of hooks or the like;

a second rod section;

second means for mounting the second rod section independently of the door in axial alignment with the first rod section;

said rod sections having a sliding fit with respect to each other and constituting an extensible assembly, said assembly being extended as the door is closed and contracted as the door is opened, said assembly being adapted to support a curtain extending across the face of the door in both closed and open positions of the door; and locking means for selectively preventing contraction of said assembly and thus the opening of the door, the locking means comprising at least one hole in one of the rod sections and a locking ring adapted to be applied to said one rod section for providing a fixed external shoulder thereon engageable with a stop member alongside said one rod section, said locking ring comprising a first elongate portion having a generally closed shape and spaced-apart ends, the ring being adapted to be carried on said one rod section being adapted in a position in which said first portion of the ring substantially surrounds said one rod section, and a second elongate portion extending from one end of the first portion inwardly with respect to said closed shape, said second portion forming a prong receivable in the hole in said one rod section when the ring is in said position surrounding the rod section thereby to releasably secure the ring on said one rod section in fixed axial position with respect thereto.

2. A curtain rod as set forth in claim 1 wherein said first and second portions of the ring are integral with each other and formed from a single length of wire.

3. A curtain rod as set forth in claim 2 wherein the wire is of circular section.

4. A curtain rod as set forth in claim 2 wherein the longitudinal axis of the wire extends in a single plane.

5. A curtain rod as set forth in claim 1 wherein said first portion of the ring is generally in the shape of an arc of a circle and said second portion extends generally radially inwardly with respect to said circle.

6. A curtain rod as set forth in claim 5 wherein an end margin of the first portion of the ring at its other end extends generally along a line tangent to said circle.

7. A curtain rod as set forth in claim 5 wherein an end margin of the first portion of the ring at its other end extends along a line parallel to and spaced from the longitudinal axis of said second portion of the ring.

8. A curtain rod as set forth in claim 7 wherein the distance between the inner end of the prong and the diametrically opposed segment of the first ring portion is less than the corresponding thickness of the second rod section.

* * * * *